US010056665B2

(12) United States Patent
Bulja

(10) Patent No.: US 10,056,665 B2
(45) Date of Patent: Aug. 21, 2018

(54) RESONATOR ASSEMBLY AND FILTER

(71) Applicant: Alcatel Lucent, Boulogne Billancourt (FR)

(72) Inventor: Senad Bulja, Blanchardstown (IE)

(73) Assignee: Alcatel Lucent, Boulogne-Billancourt (FR)

( * ) Notice: Subject to any disclaimer, the term of this patent is extended or adjusted under 35 U.S.C. 154(b) by 24 days.

(21) Appl. No.: 15/116,552

(22) PCT Filed: Jan. 20, 2015

(86) PCT No.: PCT/EP2015/050971
§ 371 (c)(1),
(2) Date: Aug. 4, 2016

(87) PCT Pub. No.: WO2015/117815
PCT Pub. Date: Aug. 13, 2015

(65) Prior Publication Data

US 2016/0351989 A1 Dec. 1, 2016

(30) Foreign Application Priority Data

Feb. 4, 2014 (EP) ..... 14305153

(51) Int. Cl.
*H01P 1/205* (2006.01)
*H01P 7/04* (2006.01)
(Continued)

(52) U.S. Cl.
CPC ..... *H01P 1/2053* (2013.01); *H01P 1/208* (2013.01); *H01P 7/04* (2013.01); *H01P 7/06* (2013.01); *H01P 11/008* (2013.01)

(58) Field of Classification Search
CPC .... H01P 7/04; H01P 7/06; H01P 1/208; H01P 1/2084; H01P 1/205; H01P 1/2053
(Continued)

(56) References Cited

U.S. PATENT DOCUMENTS 4,775,847 A * 10/1988 Epsom ..... H01P 1/00 174/51
6,353,373 B1 * 3/2002 Liang ..... H01P 1/2084 333/202
(Continued)

FOREIGN PATENT DOCUMENTS

CN 102623784 A 8/2012
CN 103022621 A 4/2013
(Continued)

OTHER PUBLICATIONS

International Search Report for PCT/EP2015/050971 dated Mar. 25, 2015.

*Primary Examiner* — Rakesh Patel
(74) *Attorney, Agent, or Firm* — Fay Sharpe, LLP

(57) ABSTRACT

A resonator assembly comprising a resonant member within a conductive resonator cavity is disclosed. The resonant member extends from a first inner surface of the resonator cavity towards an opposing second inner surface. A main portion of the resonant member has a substantially constant first cross sectional area. A cap portion of the resonant member extending from the main portion towards the opposing second inner surface has a progressively increasing cross sectional area increasing from the first cross sectional area adjacent to the main portion to a larger cap cross sectional area at an end of the resonant member, the larger cap cross sectional area being at least 1.i times as large as the first cross sectional area. The resonant member may also have a flared section at the other end giving the resonant member an hour glass type shape.

13 Claims, 8 Drawing Sheets

A Open view of hourglass resonator

(51) Int. Cl.
*H01P 11/00* (2006.01)
*H01P 1/208* (2006.01)
*H01P 7/06* (2006.01)

(58) Field of Classification Search
USPC ..... 333/206, 207, 222, 223, 203
See application file for complete search history.

(56) References Cited

U.S. PATENT DOCUMENTS

| | | | |
|---|---|---|---|
| 6,466,110 | B1 | 10/2002 | Wulff et al. |
| 7,068,128 | B1 | 6/2006 | Macdonald et al. |
| 2004/0051602 | A1 | 3/2004 | Pance et al. |
| 2004/0257177 | A1 | 12/2004 | Haapalahti |
| 2007/0296529 | A1 | 12/2007 | Zhang et al. |
| 2012/0092089 | A1* | 4/2012 | Zhu ..... H01P 1/2084 333/203 |

FOREIGN PATENT DOCUMENTS

| | | | |
|---|---|---|---|
| DE | 1015873 | | 9/1957 |
| EP | 0042110 | | 6/1981 |
| EP | 1110271 | A2 | 6/2001 |
| FR | 929468 | | 9/1957 |
| JP | S53-44347 | | 4/1978 |
| JP | 2007-13279 | | 1/2007 |
| JP | 2008-98729 | | 4/2008 |
| KR | 20-0295398 | | 11/2002 |
| KR | 20-0404258 | | 12/2005 |
| WO | 00/13256 | A2 | 3/2000 |
| WO | WO 2010/147523 | A1 | 12/2010 |

* cited by examiner

Stepped impedance resonator

Meandered resonator

A Open view of hourglass resonator

| | Hourglass resonator | Conventional resonator |
|---|---|---|
| Volume (WxLxH) $mm^3$ | 20x20x40 (16,000 $mm^3$) | 20x30x60 (36,000$mm^3$) |
| Q-factor | 1750 | 1804 |
| First spurious response (GHz) | 4.64 | 3.04 |

Performance comparison between conventional resonator and proposed hourglass resonator of Fig. 3A A five pole Chebyshev filter using hourglass resonators Insertion loss performance comparison between conventional resonator five pole Chebyshev filter —— and hourglass resonator five pole Chebyshev filter ·····

Exploded view of Fig.5 emphasising the pass-band insertion loss

Electric field distribution in the square cross section 5 pole hourglass filter

Electric field distribution in the circular cross section 5 pole hourglass filter

| | Hourglass resonator (square cross section) | Conventional resonator | Hourglass resonator (circular cross section) |
|---|---|---|---|
| Volume (WxLxH) or (diameter, H) $mm^3$ | 20x20x40 (16,000 $mm^3$) | 20x30x60 (36,000 $mm^3$) | 22, 40 (15,205$mm^3$) |
| Q-factor | 1750 | 1804 | 1830 |
| First spurious response (GHz) | 4.64 | 3.04 | 4.75 |

Performance comparison between conventional resonator and proposed hourglass resonators

RESONATOR ASSEMBLY AND FILTER

FIELD OF THE INVENTION

The present invention relates to cavity resonator assemblies and filters formed therefrom.

BACKGROUND

Filters formed from resonators are widely used in data transmission and in particular, telecommunications, for example in base stations, radar systems, amplifier linearization systems, point-to-point radio, and RF signal cancellation systems. Although a specific filter is chosen or designed dependent on the particular application, there are certain desirable characteristics that are common to all filter realisations. For example, the amount of insertion loss in the pass-band of the filter should be as low as possible, while the attenuation in the stop-band should be as high as possible. Further, in some applications the frequency separation between the pass-band and stop-band (guard band) needs to be very small, which requires filters of high order to be deployed in order to achieve this requirement. However, the requirement for a high order filter is always followed by an increase in the cost (due to the greater number of components that such a filter requires) and space.

One of the challenging tasks in filter design is to reduce their size while retaining much of their electrical performance such that they are comparable with larger structures. One of the main parameters governing filter's selectivity and insertion loss is the so-called quality factor of the elements comprising the filter—the "Q factor". The Q factor is defined as the ratio of energy stored in the element to the time-averaged power loss. For lumped elements that are used especially at low RF frequencies for filter design Q can be of the order ~60-100, whereas for cavity type resonators Q can be as high as several 1000s. Although lumped components offer significant miniaturization their low Q factor prohibits their use in highly demanding applications where high rejection and/or selectivity is required. On the other hand cavity resonators offer sufficient Q but their size prevents their use in many applications.

With the advent of small cells where the footprint of the base-station should be low the problem of reducing the size of such filters is becoming more acute. This is also the case in the currently observed trend of macro cell base-stations which seek to provide multiband solutions within a similar footprint to that of single band solutions without sacrificing system's performance. It would be desirable to reduce a resonators size while maintaining many of its properties.

SUMMARY

A first aspect of the present invention provides a resonator assembly comprising a resonant member within a conductive resonator cavity; said resonant member extending from a first inner surface of said resonator cavity towards an opposing second inner surface; a main portion of said resonant member having a substantially constant first cross sectional area; a cap portion of said resonant member extending from said main portion towards said opposing second inner surface and having a progressively increasing cross sectional area increasing from said first cross sectional area adjacent to said main portion to a larger cap cross sectional area at an end of said resonant member, said larger cap cross sectional area being at least 1.1 times as large as said first cross sectional area.

As noted above it is desirable to produce filters formed from resonators having a high performance and in particular a high quality or Q factor and yet a small size. Cavity resonators have many of the performance requirements but are generally quite large, being restricted by the physics of the system to having a size of about a quarter of the wavelength of the resonant frequency. Thus, for a resonant frequency of said 600 MHz, the quarter wavelength would be 12.5 cm, requiring a resonant member of a similar length.

One way of reducing the size of a such a cavity resonator assembly, in a traditional combline filter which comprises a plurality of resonator assemblies arranged in series, is to resort to the use of capacitive caps, i.e. to increase the diameter of the resonator's top end so as to provide a greater electric loading and hence reduce the frequency of operation such that the resonant member resonates at less than a quarter of the resonant wavelength. FIG. 1 shows an example of such a resonator assembly, however, this approach needs to be taken with care, since it results in a reduction of the Q-factor.

Another approach is shown in FIG. 2. This approach differs from that presented in FIG. 1, in that it does not rely on a strong capacitive loading at the top of the resonator. Instead, it recognises that as high frequency currents flow on the outer sides of the resonator along its length, a reduced height resonator post with a same length can be produced by making the length along the outer surface longer by using undulations. In the case of the resonator presented in FIG. 2, the electrical length of 90 degrees (or a quarter wavelength) needed for resonance at a particular frequency is achieved using a lower height resonator compared to a classical resonator by modulating the radius of the resonant post. To be specific, due to the fact that RF currents flow on the outer surfaces of the resonator (from bottom to top) a resonator with a non-uniform radius is electrically longer than the classical resonator of the same height, since the RF currents have a longer path to follow. This results in the reduction of the frequency of operation. The resonator of this form does offer a modest size reduction, but it comes at a greatly reduced Q-factor due to parasitic current coupling along the resonant post. Furthermore, this resonator is somewhat challenging to fabricate accurately due to the curved nature of the resonator.

The inventors of the present invention recognised the drawbacks of the current resonators and in particular, cavity resonators and sought to provide an improved cavity resonator assembly with a high quality factor and a reduced size. In particular, they recognised that using a capacitive cap such as is used in the stepped impedance resonator of FIG. 1 reduces the frequency of operation of the resonator allowing it to be used for a lower frequency without requiring its size to be increased as is generally required when a reduced frequency of operation is required. In this regard the size of the top area of the cap may be larger than 1.1 times the size of the area of the main portion of the resonant member, or it may be significantly larger, being more than twice as large or in some cases more than five times as large.

However, the conventional stepped impedance filter of FIG. 1 has a low quality which is due in some measure to the high mismatch of impedance at the junction between the post and cap as the impedance of the resonant member is dependent on the radius. In this regard the characteristic impedance of the bottom section is usually much higher than that of the top section. A mismatch of impedance generates reflections and increases losses. By providing a progressively increasing cross sectional area of the cap portion, such that the area increases gradually the present invention reduces the mismatch in impedance and the corresponding losses. Thus, the advantage in reduction of size can be maintained while the reduction in Q factor is significantly reduced.

Furthermore, the shape of such a resonator assembly makes it easier to make the size at the top of the resonant member to be large compared to that of the cavity while not restricting the resonance, while the design of FIG. 1 requires the size of the top of the resonant member to be significantly smaller than the cavity as it requires a reasonable amount of clearance between the cap of the resonant member and the walls of the cavity at resonance. As the size of upper surface of the resonant member affects the increase in capacitance, providing a larger top area is advantageous.

In some embodiments, the resonant member comprises a supporting portion extending from the first inner surface to the main portion, the supporting portion having a tapered cross section progressively decreasing from a larger support cross sectional area adjacent to the first inner surface of the resonator cavity to the first cross sectional area adjacent to the main portion of the resonant member, the larger support cross sectional area being at least 1.1 times as large as the first cross sectional area. The size of the larger support cross sectional area may be larger than 1.1 times the size of the area of the main portion of the resonant member, or it may be more than twice as large or in some cases more than five times as large.

The inventors of the present invention recognise that in cavity resonators the power that is dissipated in the resonator reduces the quality factor, and the power dissipated in the part of the resonator that is connected to the cavity, which is itself grounded, is high as there is again an impedance mismatch going from the relatively high impedance of the narrow post to the low impedance of the grounded plate. As noted earlier, the characteristic impedance of such a resonator member depends on its radius and, thus, increasing the radius in a progressive manner towards the ground plate will gradually decrease the impedance and in this way the mismatch in impedance will be reduced and reflections and associated power loss will also be correspondingly reduced. Therefore, designing a resonant assembly with a resonant member that has a flared upper cap and a flared bottom support member decreases the power loss of such a device and therefore increases the quality factor, whilst the increased capacitance of the top member allows the device to have a smaller size than a conventional cavity filter with a simple post.

As noted previously, the increasing capacitance of the resonator assembly is affected by the size of the cross-sectional area at the free end of the resonant member and its closeness to the opposing inner surface of the resonant cavity. In some cases, the upper surface of the cap is less than 3 mm, and preferably less than 1.5 mm from the opposing inner surface of the resonant cavity. Clearly, there is some balance to be made between the increase in capacitance with approaching proximity and the possibility of a dielectric breakthrough of the air if the gap is too small and/or the increase in manufacturing tolerances required for such a device where the gap is made particularly small. A gap of between 1.5 and 3 mm has been found to be function efficiently, although this is application specific and other gaps can be used.

In some embodiments, the resonant member has a length of between an eighth to a sixteenth of a resonant wavelength of the resonator member, preferably between an eleventh and a thirteenth.

One advantage of the current design is that the resonant member, due to the increased capacitance of the cap, will resonate not at a quarter wavelength but at a lower wavelength, thereby allowing a reduced sized resonator assembly. This reduction in size can be significant as noted above with resonance occurring between 22 to 45 degrees corresponding to an eighth to a sixteenth of the resonant wavelength. As can be appreciated this can reduce the size by a half to a quarter compared to a conventional resonator cavity with a post for resonant member that has a length of a quarter of the resonant wavelength.

In some embodiments, at least a part of the cap portion has a substantially frustoconical shape.

Although the tapered or flared shape of the free end or cap portion of the resonant member might take a number of forms, a substantially frustoconical shape provides a steady taper which is easy to manufacture and avoids step changes in the impedance.

Similarly, the supporting portion may also have a frustoconical shape.

In this regard, the supporting and cap portions may just be frustoconical or they may have a portion that is frustoconical with perhaps the extreme ends being cylindrical. This may make the member easier to manufacture and more robust whilst also supporting current flow around the extreme end portions.

In other embodiments the tapered shape may have an exponential profile such that the increase in angle increases exponentially rather than linearly as in the frustoconical case. Alternatively the profile might have the form of a logarithmic or polynomial function.

When one looks at the equations of such a characteristic impedance, it can be observed that a linear variation of the characteristic impedance is observed if the radius of the resonant post varies in an exponential fashion. Thus, if the diameter of the resonant post is increased towards that of the cavity in an exponential fashion the variation of the characteristic impedance will be linear, which results in lower reflections and, subsequently lower power dissipation due to unwanted reflections at the bottom of the resonant member. Such a shaped taper may be advantageous for both the supporting portion and the cap portion alternatively either one of the two may have this shape.

In some embodiments said larger cap section cross sectional area is at least 70% of said cross sectional area of said opposing inner surface of said resonant cavity.

The larger the cross sectional area of the free end or cap of the resonant member the higher the increase in capacitance of the resonant member and the higher the reduction in frequency of operation and therefore size of the device. Clearly the size is limited by the size of the cavity, however, a cross sectional area of the free end of the resonant member of at least 70% of the area of the opposing inner cavity surface has been found to be particularly advantageous, substantially filling the cavity while allowing space to resonate.

Similarly the larger supporting section cross sectional area is advantageously at least 70% of the area of the supporting inner surface of the cavity.

In some embodiments, said resonant member and said cavity each comprise a substantially circular cross-section.

Although the resonant member and cavity can have a number of forms, it has been found to be advantageous if they have matching forms as this improves the uniformity of any electric field and reduces hotspot currents. In particular, a circular cross-section provides an assembly with particularly low hotspot currents as opposed to an assembly formed from a more angular shape.

A further advantage of corresponding shapes is that the cross sectional area of either end of the resonant member is less limited by the size of the cavity if they have corresponding shapes.

In other embodiments, said resonant member comprises a substantially circular cross section and said resonant cavity comprises a quadrilateral cross section.

Although it has been found to be advantageous if the resonant member and resonant cavity have matching shapes such that, in particular, as this allows the free end of the resonant post is equidistant from the edge of the cavity avoiding hotspot currents, in some cases the easier manufacture of a quadrilateral cross-sectional cavity may have significant advantages. In particular, in devices such as combline filters where the cavities are arranged in a row, the disadvantage of the quadrilateral shape with regard to the property of the resonator assembly may be more than compensated for by the advantages in the design of the filter that comes from using such a shape.

Although the resonator assembly is applicable to a wide range of frequencies and the size of the resonator assembly will change with the resonant frequency, it has particular application in radio frequencies and for use in base stations for example. In such a case, a resonant frequency of between 500 MHz and 1 GHz can be achieved using resonators with resonant members between 5-3 cm. This is significantly smaller than a conventional simple post resonator cavity which would have a post size of a quarter of a wavelength and therefore be between 12.5-9 cm in this example.

In some embodiments said cap portion of said resonant member is configured to comprise a capacitive reactance which is equal in amplitude but with an opposite sign to an inductive reactance of said main portion of said resonator member.

In order for the resonant member to have a low impedance and reach resonance the capacitive reactance and inductive reactance should be matched and have opposite signs. Thus, when selecting the shape of the resonant member and in particular, the length and width of the main portion and the size of the capacitive cap, these factors need to be considered.

In some embodiments, a length of the main section is between one half and three quarters of a total length of the resonator member. Such an arrangement has been found to provide suitable properties.

A second aspect of the present invention provides a filter comprising a plurality of resonator assemblies according to a first aspect of the present invention, comprising an input resonator assembly and an output resonator assembly arranged such that a signal received at said input resonator assembly passes through said plurality of resonator assemblies and is output at said output resonator assembly; an input feed line configured to transmit a signal to an input resonator member of said input resonator assembly such that said signal excites said input resonator member, said plurality of resonator assemblies being arranged such that said signal is transferred between said corresponding plurality of resonator members to an output resonator member of said output resonator assembly; an output feed line for receiving said signal from said output resonator member and outputting said signal.

These types of resonator assemblies are particularly useful when combined together to form a filter which may be used, for example, in base stations in wireless communication networks. They have high quality factors and yet reduced size compared to conventional cavity filters.

These resonator assemblies are particularly applicable for use as radio frequency filters and/or a combline filter.

In such a filter the input and output lines may contact the resonant member at the main portion, causing it to resonate, or they may be located close to but not contacting the resonant member such that the signal is transferred by capacitive coupling.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present invention will now be described further, with reference to the accompanying drawings, in which.

DESCRIPTION OF THE EMBODIMENTS

Before discussing the embodiments in any more detail, first an overview will be provided.

A resonator assembly suitable for use in filters such as radio frequency and/or combline filters is disclosed. The resonant member has a cap portion at its free end that has a flared shape such that the cross sectional area increases from the central post like section to an end which has the form of an upper circular plate close to an inner wall of the cavity. This cap portion provides an increase in capacitance to the resonant member thereby allowing the resonator assembly to operate at a lower frequency than a conventional cavity resonator of the same size. A relatively small cavity resonator is thereby provided with a high quality factor.

In a preferred embodiment the resonant member has an hourglass shape such that the part of the resonant member attached to the resonant cavity has a similar tapered or flared shape to the cap portion.

Such resonators address the shortcoming of a stepped impedance resonator, namely the low Q factor, while retaining and indeed often exceeding the desirable small volume. Their principle of operation is described below.

The tapered section at the end attached to the cavity causes a reduction in dissipated power in the short circuited end of the resonator. This section does not need to be long just sufficiently long to provide a smooth transition in impedance and thereby reduce the dissipated power. The main central portion is responsible for the inductive energy storage and can be made with an appropriately small diameter to satisfy the required resonant condition. The cap portion introduces a capacitive reactance, which in preferred embodiments is equal in amplitude, but with an opposite sign to the inductive reactance introduced by the main section. Increasing the diameter of the cap section, increases the capacitive loading and yields a lower frequency of operation and therefore a reduced size resonator assembly compared to corresponding resonator assemblies of the prior art.

Figure 1:
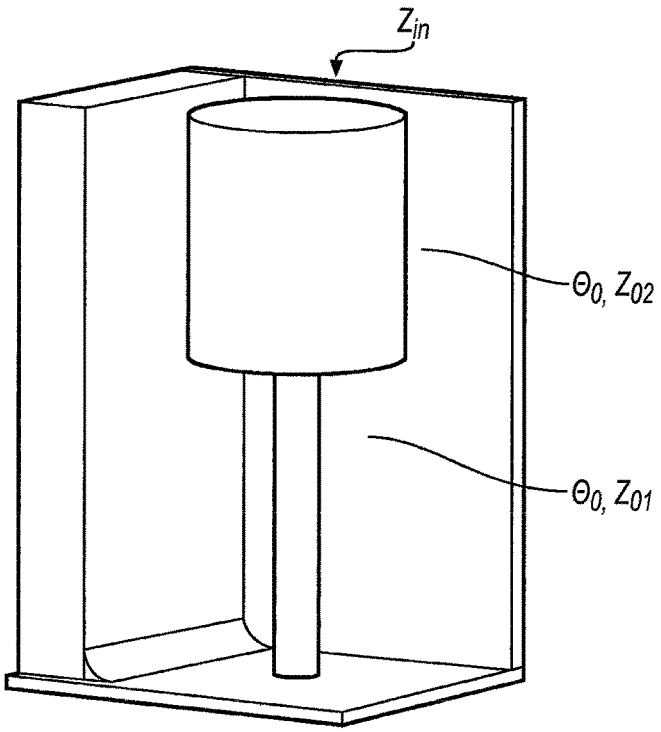
FIG. 1 (Prior art)
FIG. 1 illustrates a stepped impedance resonator according to the prior art.
Figure 2:
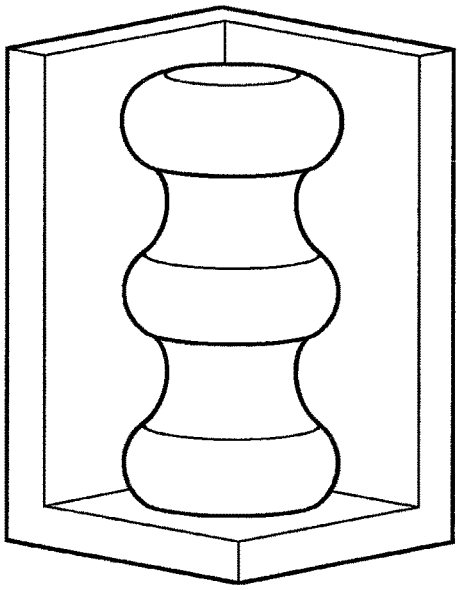
FIG. 2 (Prior art)
FIG. 2 illustrates a meandered resonator according to the prior art.

An explanation of how the shape of the resonant member affects the operation of the resonator assembly is now provided starting from the stepped impedance resonator or resonator assembly of FIG. 1.

The expression for the Q-factor of this resonator assembly can be written as:

$$Q = 2\pi f_0 \frac{W_1 + W_2}{P_s + P_1 + P_2} \tag{1}$$

Where, $W_1$ and $W_2$ represent the energy that is stored in the resonator parts of the resonant member of FIG. 1 each having characteristic impedances, $Z_{01}$ and $Z_{02}$, respectively. $P_1$ and $P_2$ represent the power that is dissipated in the resonator parts of the resonant member of FIG. 1 of the same characteristic impedance. $P_s$ in (1) represents the dissipated power in the short ended part of the resonator (the supporting portion attached to the cavity) and can be represented as $$P_s = \left(\frac{r_s}{4\pi}\right) I_0^2 \ln\left(\frac{b}{a}\right) \tag{2}$$

In equation (2), $r_s$ is the surface resistivity of the conductive post, $I_0$ represents the current at the short circuited end of the line, whereas b and a stand for the outer and inner effective diameters of the resonant cavity and the resonant post respectively. ("Effective" in this sense means that that the cross section of the resonator of FIG. 1 can be rectangular in which case an "effective" radius needs to be defined).

In the design of stepped impedance resonators, the characteristic impedance of the bottom section of the complete resonator, $Z_{01}$, is usually much higher than the characteristic impedance of the top section of the complete resonator, $Z_{02}$, since that combination provides the desired reduced frequency of operation, albeit it comes at the cost of a reduced Q factor. The main reason for the reduction of the Q-factor lies with equation (2), which states that the power losses in the short circuited section are increased by the reduction of the diameter of the bottom part of the resonator of FIG. 1. In order to reduce the dissipated power in this section, the diameter of the bottom section of the resonator of FIG. 1 needs to be as wide as possible—the ultimate minimum case is established when $$\lim_{a \to b} (P_s) = 0 \tag{3}$$

i.e. when effective diameters a and b are equal. However, such a requirement imposes the need for the resonant post to be as wide as the resonant chamber which, in turn, renders the resonator useless, since in this case the resonator cannot resonate.

Figures 3A, 3B:
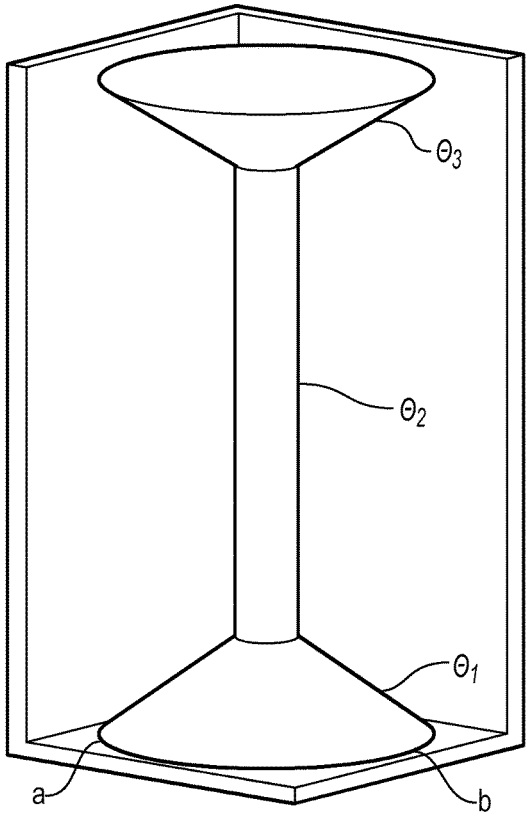
FIG. 3A is an open view of a resonator assembly according to an embodiment of the present invention.
FIG. 3B shows a table giving performance comparison between a stepped impedance resonator of the prior art and the resonator of FIG. 3A.

The present application seeks to provide a solution to this problem. In order to satisfy equation (3), but at the same time make the resonator able to resonate, a short tapered section is introduced at the short-ended part of the resonator, such that the section is wider at the bottom of the resonator, as this provides a reduced power loss in the short circuited section while allowing the resonator to resonate. FIG. 3A is an example of a resonator according to an embodiment of the present invention where the cross section of the resonant cavity is square. However, other cross sections are envisaged such as rectangular or circular.

The resonator assembly of FIG. 3A is termed an "hourglass resonator", due to its resemblance to an hourglass. It addresses the shortcoming of a stepped impedance resonator, namely the low Q factor, while retaining the desirable small volume. Its principle of operation is now described.

The section with a length of $\Theta_1$ is responsible for the reduction of dissipated power in the short circuited end of the resonator, in line with equation (3). This section does not need to be long—a few degrees of the signal are enough to ensure a smooth transition and reduce the dissipated power. The second section, termed $\Theta_2$ is responsible for the inductive energy storage and can be made with a sufficiently small diameter so as to satisfy the resonant condition. The third part, $\Theta_3$, introduces the necessary capacitive reactance, in this case equal in amplitude, but with the opposite sign to the inductive reactance introduced by section $\Theta_2$ . The diameter of the top part of this section, $\Theta_3$ be increased so that its capacitive loading is increased to yield a lower frequency of operation.

To demonstrate the strength and potential of the proposed resonator, its representative performance is compared to a conventional resonator (with a slight capacitive loading to reduce its height) resonating at the same frequency (714 MHz) and is provided in the table of FIG. 3B. It should be noted that these values are representative only, and better performance of the hourglass resonator may well be possible.

As is evident from the table in FIG. 3*b*, the proposed resonator exhibits a volume that is 2.25 times lower than the compared conventional resonator, with only a slight reduction in the Q-factor (less than 3%). This reduction in the Q-factor is almost negligible. Further, the first spurious response of the hourglass resonator occurs at 4.64 GHz, which is 6.5 times higher than its fundamental resonant frequency; whereas the first spurious response of the conventional resonator is at 3.04 GHz, corresponding to the frequency that is 4.25 times higher than the fundamental resonant frequency of the conventional resonator.

The example given is for a resonant frequency of 714 MHz. The length of the two tapered sections in this embodiment is 3-4 degrees while the length of the central section is about 15 degrees. This provides an overall length of 21 to 23 degrees, which is significantly smaller than the length of a post resonator resonating at a quarter wavelength that is 90 degrees. In general resonators of embodiments of the present invention may have resonant members of between 20 and 40 degrees; that is one eighteenth to a ninth of a wavelength at the resonant frequency. So where the resonant frequency is 714 MHz, 20 degrees represents $1/18^{th}$ of the wavelength, which can be derived from 300/714 m, in other words the speed of light divided by the frequency and is in the region of 2.5 cm.

Figure 4:
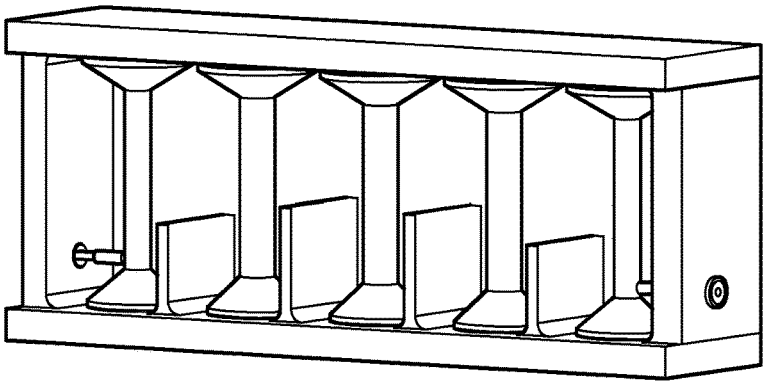
FIG. 4 shows a five pole Chebyshev filter according to an embodiment of the present invention.
Figure 5:
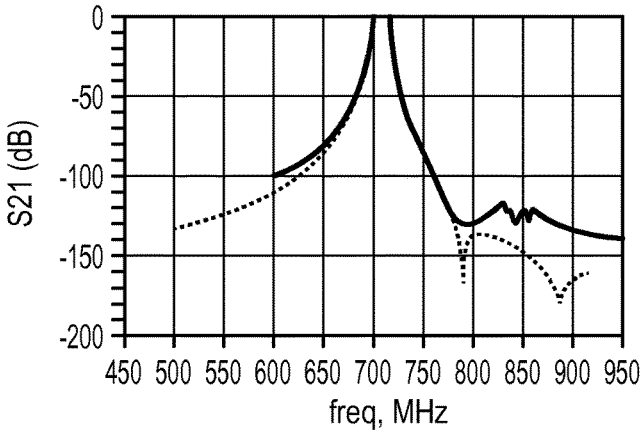
FIG. 5 shows the insertion loss performance comparison between conventional resonator five pole Chebyshev filter and a hour glass resonator five pole Chebyshev filter according to an embodiment of the present invention.
Figure 6:
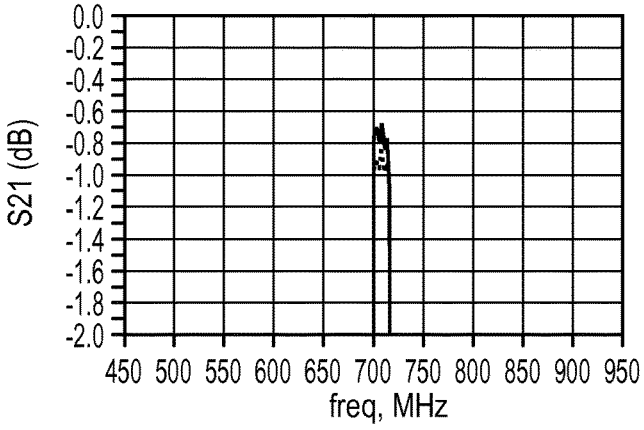
FIG. 6 shows an exploded view of FIG. 5.

To further demonstrate the potential of the proposed resonator, a five pole filter using hourglass resonators is shown in FIG. 4, and its performance is compared to the conventional five pole filter operating in the same frequency band, FIGS. 5 and 6.

As is evident from FIGS. 5 and 6, the overall insertion loss performance of the hourglass five pole filter is degraded by less than 0.1 dB in the passband as compared to the conventional filter, which is adequate for most applications.

In order to understand the power handling capability of the proposed filter, let us have a look as to what parameters influence power handling. Neglecting passive inter-modulation (PIM), since this phenomenon depends on the quality of the junctions and surface planarity, the limiting factor which determines power handling lies with the maximum electric field strength inside the cavities of the filter. The maximum electric field before the dielectric breakdown in air occurs at $3\times10^6$ V/m, according to the available literature. The strength of the electric field in any device is ultimately dependent on the distribution of electric charges in the conductors. As a rule of thumb, it is desirable to have a charge distribution that is as uniform as possible, since unequal distribution leads to the creation of "hotspots", i.e. areas where the electric field can be several magnitudes greater than anywhere else in the conductor. These "hotspots" of the charge distribution and hence the electric field, are detrimental not only from the power handling point of view, but they also negatively impact the Q-factor of the resonant structure, since the "hotspots" are areas with a significant loss of power, due to the increased current density.

Figure 7:
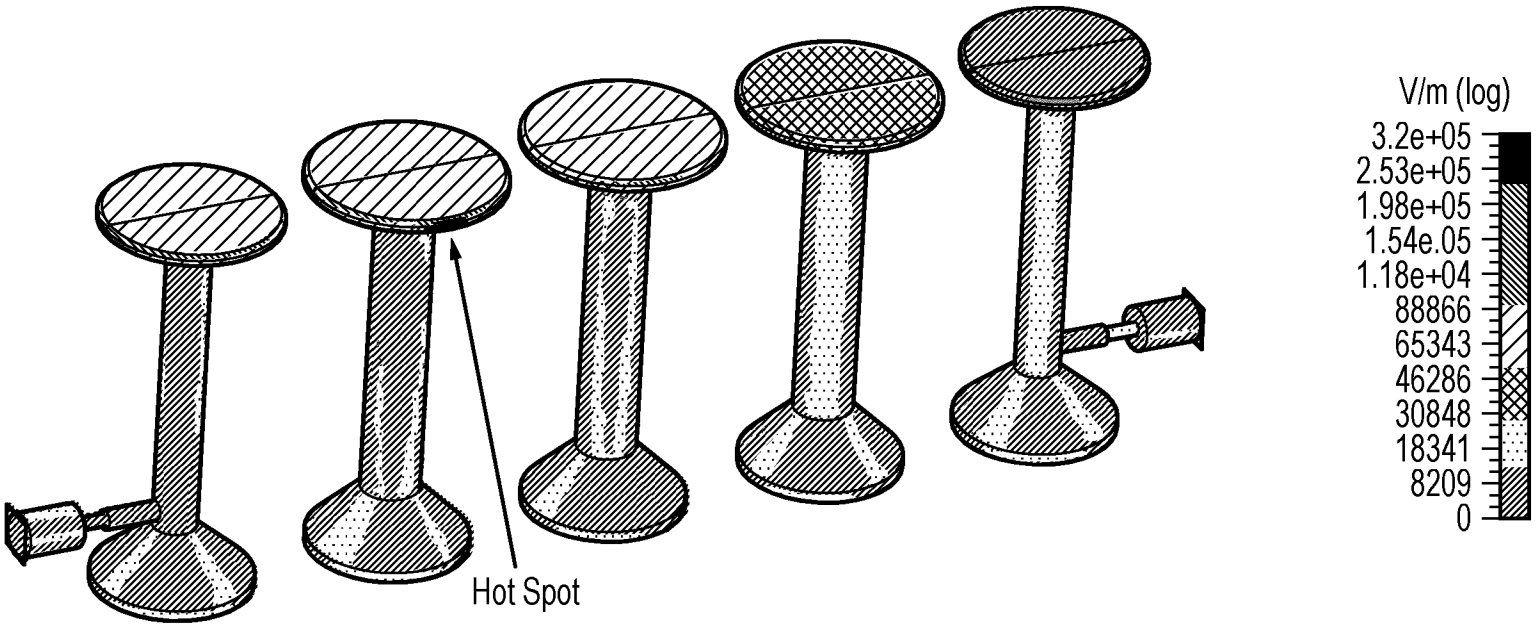
FIG. 7 schematically shows the electric field distribution in a 5 pole hourglass filter with square resonator cavities.

For example, let us consider the 5 pole filter of FIG. 4 where the top edges of the resonators are smoothed, so as to avoid the creation of charge discontinuities. Further, it is worth noting that in this case, the cross section of the resonant chamber is square and that the edges of the circular top of the hourglass resonator are not equidistant from the housing of the resonator. The distribution of the electric field inside the filter is given in FIG. 7. The maximum electric field at an average input power of 0.5 W occurs at 3.2×105 V/m, which gives a maximum average input power of 4.68 W at which the dielectric breakdown in air occurs. Looking more closely at the distribution of the electric field it becomes dear from FIG. 7 that the maximum electric field occurs on the top of the second resonator (given in red) at the edges closest to the body of the housing, while the electric field elsewhere is more equally distributed. In order to increase the power handling capability of this resonator type, the creation of these hotspots should be avoided or at least reduced. This can be achieved in a variety of ways; however, the simplest way is to change the cross section of the cavity, from a square to a circle. In this way, a more equal distribution of electric charges is achieved and, therefore, not only is the power handling capability increased, but the Q-factor is also increased.

Figures 9, 10:
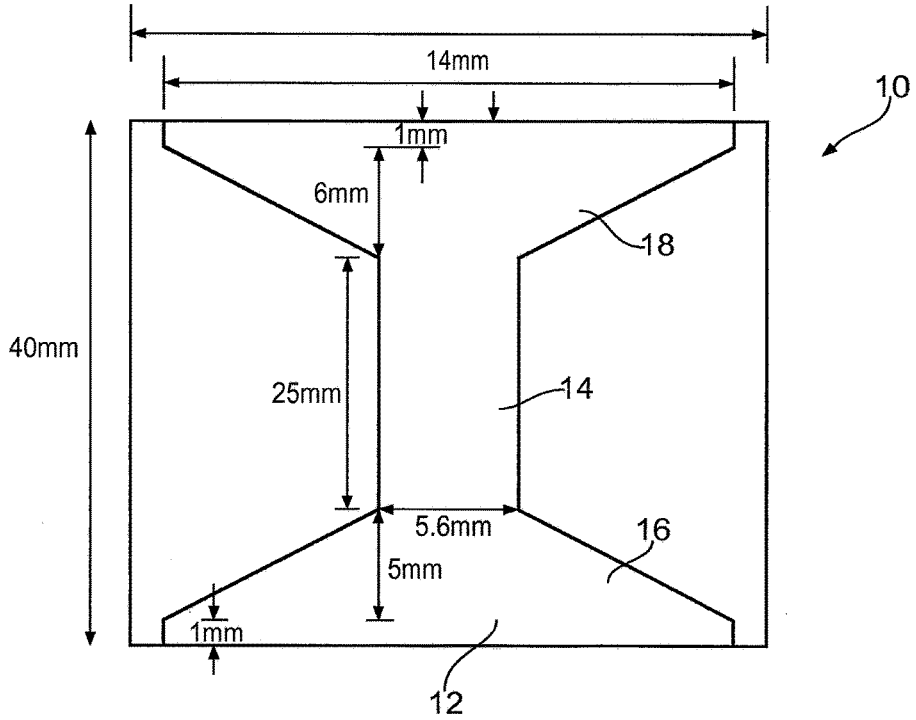
FIG. 9 shows a table showing performance characteristics between conventional resonators and hourglass resonators of the embodiments of FIGS. 7 and 8.
FIG. 10 schematically shows a resonator assembly for resonant frequencies of about 700 MHz.

The table in FIG. 9 gives a comparison. As can be seen from this table, by changing the shape of the cross section of the resonator from a square to a circle, the Q factor has increased, and, also the first spurious response is now at 4.75 GHz instead of 4.64 GHz. Further, the volume occupied is decreased by approximately 5%. Overall the volume reduction compared to the conventional resonator is about 2.36 times, with no reduction in the unloaded Q factor. Indeed the Q factor of the circular cross section hourglass resonator is better than the Q factor of the conventional resonator.

Figure 8:
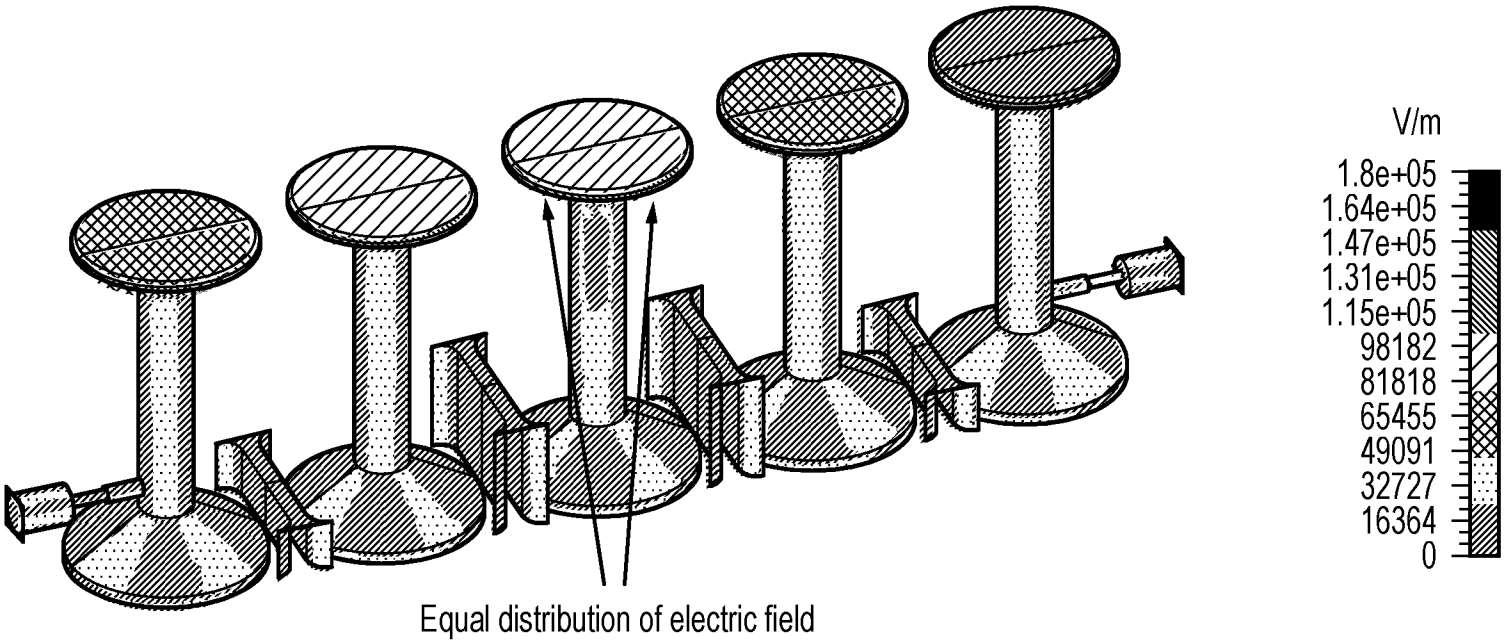
FIG. 8 schematically shows the electric field distribution in a 5 pole hourglass filter with circular resonator cavities.

Looking now at the power handling capability, a 5 pole circular cross section filter has been designed to operate in the same frequency range as its square cross section counterpart. The maximum electric fields inside the cavity are presented in FIG. 8. As is clear from this figure, the maximum strength of the electric field occurs on the edges on top of the third resonator and is approximately equal to $1.8\times10^5$. Using the same justification as in the case of the hourglass resonator with a square cross section, the maximum average input power before dielectric breakdown is about 8.3 W, which is nearly two times more than that in the case of the square cross section hourglass resonator. It is important to note that the presented hourglass resonators (with square and circular shapes) are not optimised and better performance in terms of power handling and insertion loss may well be possible.

An example resonator assembly with dimensions is shown in FIG. 10. This resonator assembly 10 is configured for operation at around the 700 MHz frequency and has a cavity size of 40×15×15 mm. The resonant member 12 has a central section 14 that is 25 mm long and a 5 mm long supporting section 16 and a 6 mm long cap section 18. The largest diameter of the two tapered sections is 14 mm while the central section of the resonant member has a diameter of 5.6 mm. In this example both ends of the resonant member have a cylindrical section with a diameter of 14 mm and a length of 1 mm.

Figure 11:
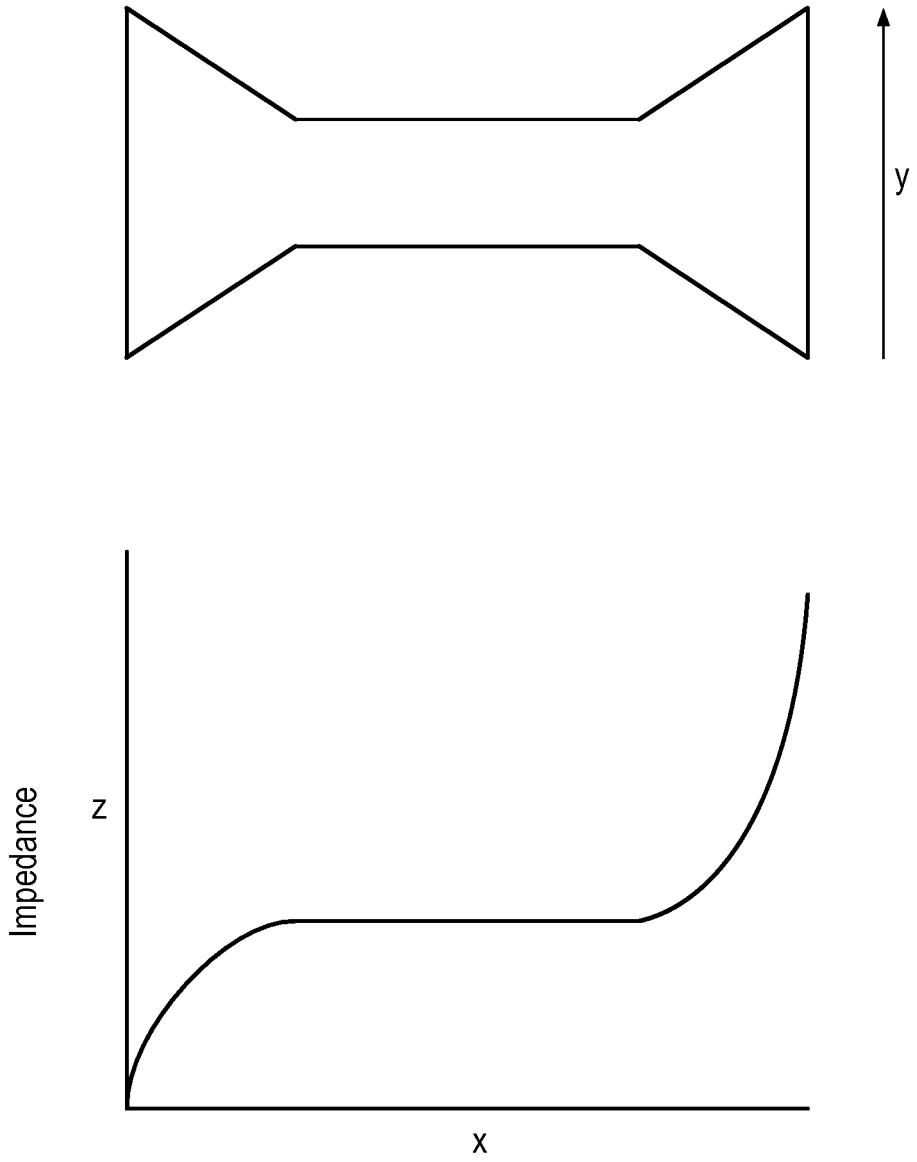
FIG. 11 schematically shows a resonant member with linear tapered sections along with changes in the impedance of such a resonant member when mounted in a resonator assembly.

Figure 11 shows schematically how the impedance of the resonant member of a resonator assembly having frustoconical tapered sections varies along the length of the resonant member. As can be seen the change in impedance varies in an exponential function with the width of the resonator y. In effect impedance Z=f (ln y).

Figure 12:
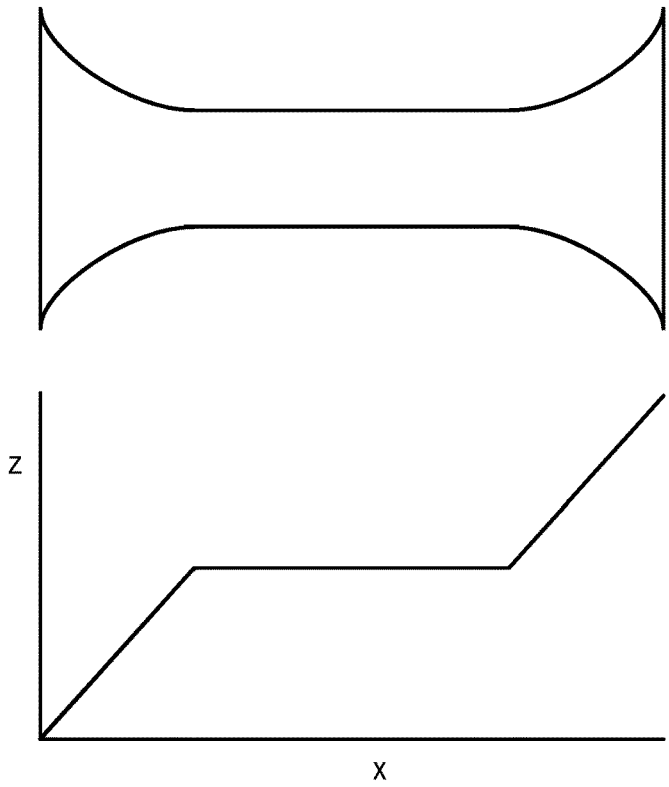
FIG. 12 schematically shows a resonant member with an exponential change in effective diameter of the tapered section and the corresponding changes in impedance.

FIG. 12 shows schematically how the impedance Z of the resonant member of a resonator assembly having exponentially tapered end portions varies. In this case the diameter of the two end portions of the resonant member increases from the central section in an exponential manner such that the diameter y is a function of $e^x$. In this case the impedance Z is a linear function of x, Z=f(x). This linear progression in the impedance provides an improved quality factor for the resonator assembly with a reduced power loss.

Figure 13:
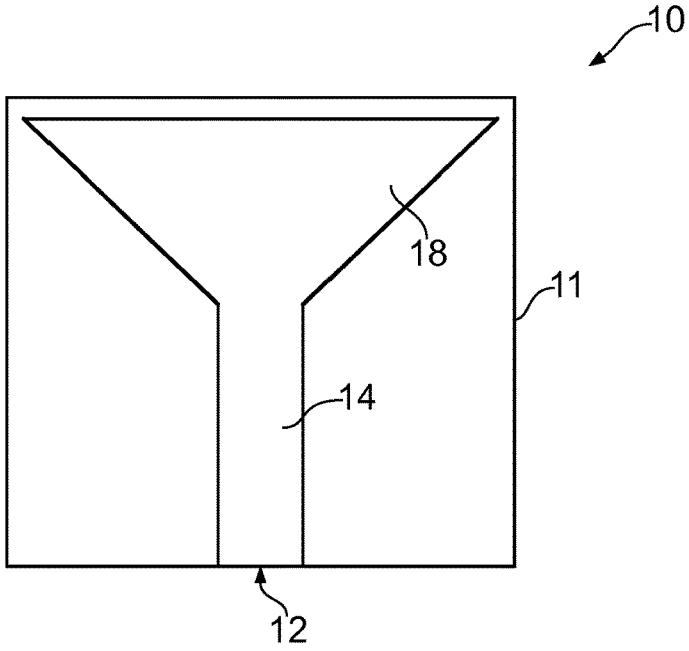
FIG. 13 shows a resonator assembly according to a further embodiment of the present invention.

FIG. 13 shows a further example of a resonator assembly 10 having a resonator cavity 11 and a resonant member 12. In this embodiment the resonant member has a post like section 14 at the supporting end and a flared cap portion 18 at the free end. Thus, an increase in capacitance is provided to reduce the frequency of operation and provide the decreased size. However, there will be additional power losses compared to the hourglass embodiments due to the impedance mismatch at the end of the resonant member 12 attached to cavity 11.

A person of skill in the art would readily recognize that steps of various above-described methods can be performed by programmed computers. Herein, some embodiments are also intended to cover program storage devices, e.g., digital data storage media, which are machine or computer readable and encode machine-executable or computer-executable programs of instructions, wherein said instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

The functions of the various elements shown in the Figures, including any functional blocks labelled as "processors" or "logic", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" or "logic" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the Figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A resonator assembly comprising a resonant member within a conductive resonator cavity;

said resonant member extending from a first inner surface of said conductive resonator cavity towards an opposing second inner surface;

a main portion of said resonant member having a substantially constant first cross sectional area, wherein the first cross sectional area is an area of a cross section that is perpendicular to an axis of the main portion;

a cap portion of said resonant member extending from said main portion towards said opposing second inner surface and having a progressively increasing cross sectional area increasing from said first cross sectional area of said main portion to a larger cap cross sectional area at an end of said resonant member, said larger cap cross sectional area being at least 1.1 times as large as said first cross sectional area; wherein said resonant member has a length of between a sixteenth to an eighth of a resonant wavelength of said resonator assembly; and said larger cap cross sectional area is at least 70% of said cross sectional area of said opposing inner surface of said conductive resonator cavity.

2. A resonator assembly comprising a resonant member within a conductive resonator cavity;

said resonant member extending from a first inner surface of said conductive resonator cavity towards an opposing second inner surface;

a main portion of said resonant member having a substantially constant first cross sectional area, wherein the first cross sectional area is an area of a cross section that is perpendicular to an axis of the main portion;

a cap portion of said resonant member extending from said main portion towards said opposing second inner surface and having a progressively increasing cross sectional area increasing from said first cross sectional area of said main portion to a larger cap cross sectional area at an end of said resonant member, said larger cap cross sectional area being at least 1.1 times as large as said first cross sectional area; wherein said resonant member has a length of between a sixteenth to an eighth of a resonant wavelength of said resonator assembly; and said cap portion of said resonant member is configured to comprise a capacitive reactance which is equal in amplitude but with an opposite sign to an inductive reactance of said main portion of said resonator member.

3. A resonator assembly comprising a resonant member within a conductive resonator cavity;

said resonant member extending from a first inner surface of said conductive resonator cavity towards an opposing second inner surface;

a main portion of said resonant member having a substantially constant first cross sectional area, wherein the first cross sectional area is an area of a cross section that is perpendicular to an axis of the main portion;

a cap portion of said resonant member extending from said main portion towards said opposing second inner surface and having a progressively increasing cross sectional area increasing from said first cross sectional area of said main portion to a larger cap cross sectional area at an end of said resonant member, said larger cap cross sectional area being at least 1.1 times as large as said first cross sectional area; wherein said resonant member has a length of between a thirteenth and an eleventh of a resonant wavelength of said resonator assembly.

4. A resonator assembly comprising a resonant member within a conductive resonator cavity;

said resonant member extending from a first inner surface of said conductive resonator cavity towards an opposing second inner surface;

a main portion of said resonant member having a substantially constant first cross sectional area, wherein the first cross sectional area is an area of a cross section that is perpendicular to an axis of the main portion;

a cap portion of said resonant member extending from said main portion towards said opposing second inner surface and having a progressively increasing cross sectional area increasing from said first cross sectional area of said main portion to a larger cap cross sectional area at an end of said resonant member, said larger cap cross sectional area being at least 1.1 times as large as said first cross sectional area; wherein said resonant member has a length of between a sixteenth to an eighth of a resonant wavelength of said resonator assembly; and said resonant member comprises a supporting portion extending from said first inner surface to said main portion, said supporting portion having a tapered cross section progressively decreasing from a larger support cross sectional area adjacent to said first inner surface of said conductive resonator cavity to said first cross sectional area of said main portion of said resonant member, said larger support cross sectional area being at least 1.1 times as large as said first cross sectional area.

5. The resonator assembly according to claim 4, wherein at least a part of said supporting portion has a substantially frustoconical shape.

6. The resonator assembly according to claim 4 wherein at least a part of said cap portion has a substantially frustoconical shape.

7. The resonator assembly according to claim 4, wherein said progressively increasing cross sectional area increases as at least one of an exponential, logarithmic, polynomial and linear function.

8. The resonator assembly according to claim 4, wherein said resonant member and said conductive resonator cavity each comprise a substantially circular cross section.

9. The resonator assembly according to claim 4, wherein said resonant member comprises a substantially circular cross section and said conductive resonator cavity comprises a quadrilateral cross section.

10. The resonator assembly according to claim 4, wherein a length of said main portion of said resonant member is between one half and three quarters of a total length of said resonant member.

11. A filter comprising:

a plurality of resonator assemblies according to claim 4 comprising an input resonator assembly and an output resonator assembly arranged such that a signal received at said input resonator assembly passes through said plurality of resonator assemblies and is output at said output resonator assembly;

an input feed line configured to transmit a signal to an input resonator member of said input resonator assembly such that said signal excites said input resonator member, said plurality of resonator assemblies being arranged such that said signal is transferred between said corresponding plurality of resonator members to an output resonator member of said output resonator assembly; and an output feed line for receiving said signal from said output resonator member and outputting said signal.

12. The filter according to claim 11, wherein said input feed line is configured to transmit said signal to said input resonator assembly at said main portion thereof and said output feed line is configured to receive said signal from said main portion of said output resonator member.

13. The filter according to claim 11, said filter being at least one of a radio frequency filter and a combline filter.

* * * * *